US005582244A

United States Patent [19]

Helms et al.

[11] Patent Number: 5,582,244

[45] Date of Patent: Dec. 10, 1996

[54] FIN FOR A HEAT EXCHANGER

[75] Inventors: Werner Helms; Roland Hemminger, both of Esslingen, Germany

[73] Assignee: Behr GmbH & Co., Stuttgart, Germany

[21] Appl. No.: 389,049

[22] Filed: Feb. 15, 1995

[30] Foreign Application Priority Data

Feb. 16, 1994 [DE] Germany ..... 44 04 837.8

[51] Int. Cl.[6] ..... F28F 1/32

[52] U.S. Cl. ..... 165/151; 165/182; 165/DIG. 501; 165/DIG. 503

[58] Field of Search ..... 165/151, 182, 165/DIG. 501, DIG. 503

[56] References Cited

FOREIGN PATENT DOCUMENTS

| | | |
|---|---|---|
| 127067 | 2/1932 | Austria . |
| 9109424 | 10/1991 | Germany . |
| 4129573 | 3/1993 | Germany . |
| 1075272 | 7/1967 | United Kingdom . |
| 1174402 | 12/1969 | United Kingdom . |
| 2047399 | 11/1980 | United Kingdom . |
| 2088035 | 6/1982 | United Kingdom . |

*Primary Examiner*—Allen J. Flanigan
*Attorney, Agent, or Firm*—Foley & Lardner

[57] ABSTRACT

The fin for a heat exchanger which consists essentially of a matrix of tubes and of fins disposed transversely to the latter, the fin having pass-through elements to receive tubes which are to be joined mechanically, while a first, preferably liquid medium flows through the tubes and the fin is acted on by a second, preferably gaseous medium. Multiple fins are positioned in their fin pitch by integral spacers, wherein the spacers are in the form of noses stamped out of the pass-through elements and distributed over the periphery of the latter.

18 Claims, 4 Drawing Sheets

20
22
21
25
22
24
23
27
26

28/30
29
20
21
25
28
29
26
30
27

31
21
25'
26'
27'

21
32
25''
26''
33
27''
34

FIN FOR A HEAT EXCHANGER

BACKGROUND OF THE INVENTION

The invention relates to a fin for a heat exchanger, consisting essentially of a matrix of tubes and of fins disposed transversely to the latter, said fins having pass-through elements to receive tubes which are to be joined mechanically, while a first, preferably liquid medium flows through the tubes and the fins are acted on by a second, preferably gaseous medium and are positioned in their fin pitch by integral spacers.

Heat exchanger fins are known from DE-A-37 28 969 and also from DE-C-34 23 746. The power of a heat exchanger is governed, among other factors, by its fin density or so-called fin pitch (number of fins per decimeter), and to ensure uniform quality this predetermined fin density must therefore be accurately maintained, for which reason spacers intended to position the fins on the tubes are provided. Such spacers can be formed either as tabs produced from the fin sheet, which then also serve as turbulence producers, or by bent-over contact surfaces attached at the ends of the pass-through elements of the fins.

In the case of DE-A '969 these contact surfaces are in the form of tongues distributed over the periphery, while in the case of DE-C '746 they are sickle-shaped contact surfaces arranged on the longer sides of the ellipses. In such arrangements it may be a disadvantage that, when the tubes are expanded in relation to the pass-through elements of the fins, complete contact is no longer ensured between the pass-through element and the tube. In addition, the bending-over of the contact surfaces constitutes an additional operation after the formation of the pass-through elements.

SUMMARY OF THE INVENTION

One object of the present invention is to improve a fin of the kind initially defined in such a manner that on the one hand secure spacing apart of the fins and on the other hand good heat transfer between the tube and the fins are achieved, while in addition simple manufacture is possible.

This object is achieved by the fin for a heat exchanger consisting essentially of a matrix of tubes and of fins disposed transversely to the latter, the fins having pass-through elements to receive tubes which are to be joined mechanically, while a first, preferably liquid medium flows through the tubes and the fins are acted on by a second, preferably gaseous medium and are positioned in their fin pitch by integral spacers, wherein the spacers are in the form of noses stamped out of the pass-through elements and distributed over the periphery of the latter.

The novel spacers in the form of noses are partly stamped outwards from the wall of the pass-through element, so that their top edge forms a contact surface for the fin situated above it. Owing to the fact that a plurality of noses are distributed over the periphery of the pass-through element, good, stable support is provided for the next fin. The noses can moreover be produced in a simple manner, because the additional operation of bending-over after the pass-through element has been formed is eliminated. Heat transfer is also ensured, since the noses provided are only partial and thus scarcely restrict the passage of heat between the inner surface of the pass-through element and the outer surface of the tube.

Advantageous developments of the invention are discussed below, while the invention can advantageously be applied both to tubes having circular cross sections and to those having oval or elliptical cross sections. The noses advantageously have approximately the shape of half-pyramids or half-cones, which are divided vertically and widen upwardly, that is to say in the pass-through direction. The bottom tip of a nose of this kind, for example in the form of a half-cone, is advantageously arranged slightly above the plane of the fin, so that a continuous circumferential contact surface of a certain width is maintained between the tube and the pass-through element of the fin, thus ensuring good heat transfer. Since consequently a relatively great height of the pass-through element is not necessary for reasons of heat exchange, the noses are stamped in tabs which have a greater height than the remainder of the pass-through element and which thus dictate the value of the fin pitch or spacing. In the case of oval or elliptical cross sections of the pass-through element it is advisable for the noses to be offset relative to one another for manufacturing reasons—the maximum height of the tabs can be obtained thereby. If the fin spacing is less than the width of the pass-through element, the noses or tabs may also lie opposite one another.

Finally, the invention also relates to a process for producing the pass-through elements provided with the noses, this being carried out in three or four successive operations, the impression of the noses being effected by a punch stroke either in the pass-through direction or oppositely thereto.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred exemplary embodiments of the invention, and, together with the general description given above and the detailed description of the preferred embodiments given below, serve to explain the principles of the invention.

One exemplary embodiment of the invention is described more fully below and illustrated in the drawings, in which.

DETAILED DESCRIPTION OF THE PREFERRED EMBODIMENTS

Figure 1:
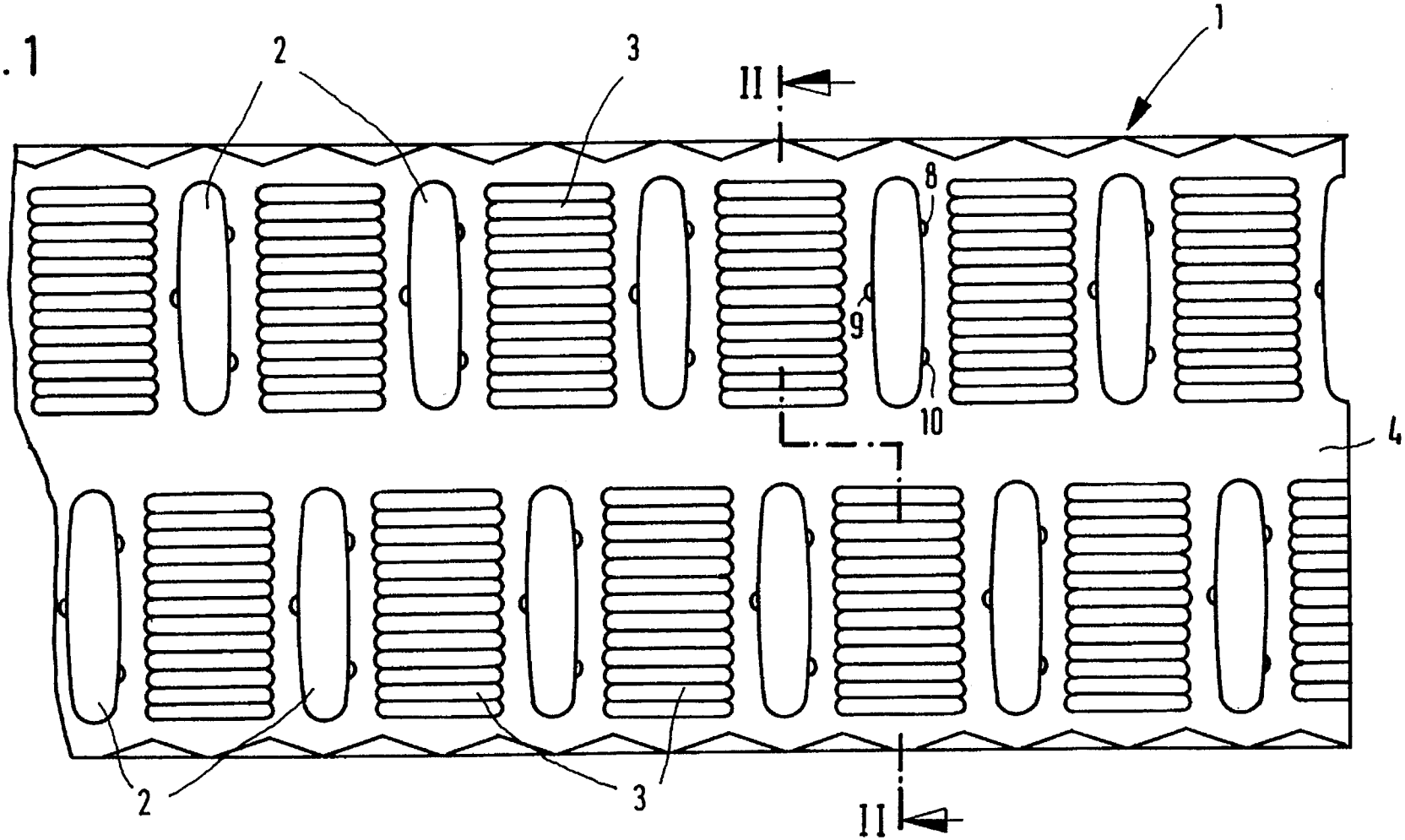
FIG. 1 shows a fin in plan view.

FIG. 1 shows in plan view a fin 1 having pass-through elements 2 which have a flat oval shape and are arranged in two rows offset relative to each other, and gill areas 3 being arranged in each case between the pass-through elements 2. The pass-through elements 2 receive tubes (not shown) which have identical cross sections and which are mechanically expanded relative to the pass-through elements and thus provide the contact required for heat conduction or heat transfer. In the region where no gill areas 3 and no pass-through elements 2 are provided, the fin 1 forms an essentially plane surface 4. Each pass-through element 2 has three noses 8, 9, 10, as will be explained more fully below. The fin 1 is preferably made of aluminum or an aluminum alloy and has a thickness of about 0.1 millimeter.

Figure 2:
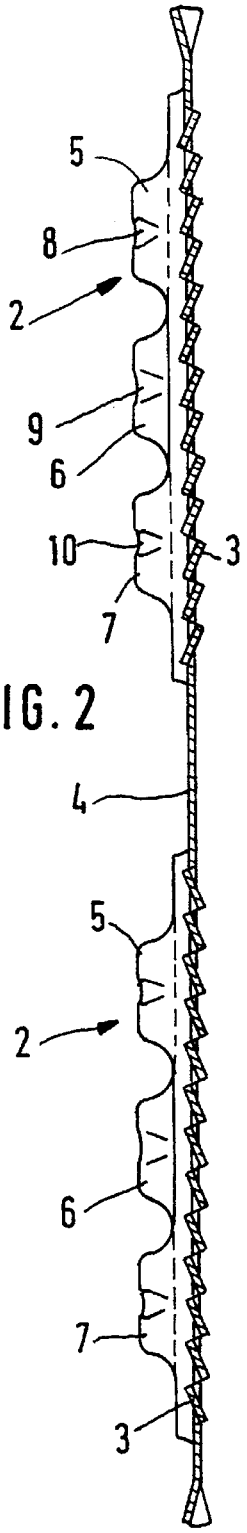
FIG. 2 shows on a larger scale, in section, the fin shown in FIG. 1.

FIG. 2 shows on a larger scale a section II—II through the fin shown in FIG. 1, so that in particular the inclined gills, known per se, of the gill areas 3 can be seen. They cause a deflection of the air passing over the fins, whereby the transfer of heat on the air side is intensified. In this figure two pass-through elements 2 are shown in side view, it being possible in each case to see three tabs 5, 6, 7 in which the noses 8, 9, 10 are in each case impressed centrally. The tabs 5, 6, 7 are thus offset in relation to one another, that is to say the tabs 5 and 7 lie at the front and the tab 6 lies at the rear, that is to say on the rear longitudinal side of the pass-through element 2.

Figure 3:
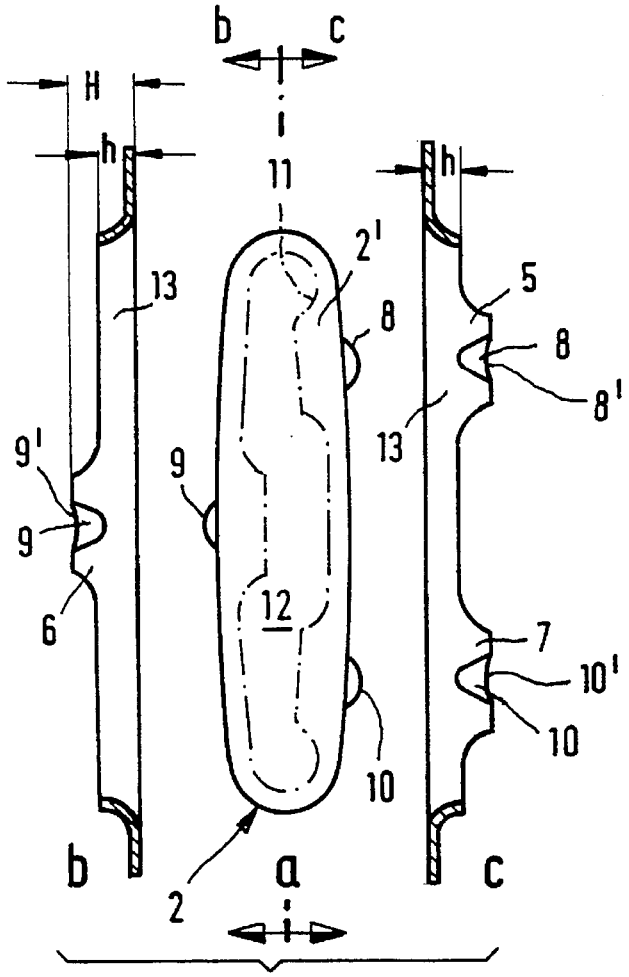
FIG. 3 shows on a larger scale a pass-through element of the fin shown in FIG. 1, FIGS. 4*a*, 4*b*, 4*c* and 4*d* show the individual steps of the process for the production of the pass-through element provided with noses.

In FIG. 3 a pass-through element 2 is shown, likewise on a larger scale, namely in a plan view a as a flat oval shape, in which the noses 8, 9, 10 can clearly be seen as bulges having the shape of segments of a circle. A dot-dash line 11 is shown in the interior of the flat oval pass-through element 2 and bounds a stamped-out portion 12, so that the pass-through area 2' can be seen in the plane state before formation of the pass-through element. On the right and left of the pass-through element a, sections c and b of the pass-through element are shown, the illustration b on the left indicating the centrally situated tab 6 provided with the nose 9, while the right-hand illustration c indicates the two tabs 5 and 7 situated eccentrically and provided with the noses 8 and 10. The noses 8, 9, 10 have in each case an outwardly falling top edge 8', 9', 10', which produces the spacing H' (see FIG. 6) of the fins. It can be seen that the height H of the tabs 5, 6, 7 exceeds the height h of the remainder of the pass-through element, although a continuous region 13 is obtained which has the height h and bears all around against the outside circumference of the tube, so that a closed heat transfer surface is formed between the fin and the tube, this surface moreover also maintaining the elastic stress necessary after the expansion.

Figures 4A, 4B, 4C, 4D:
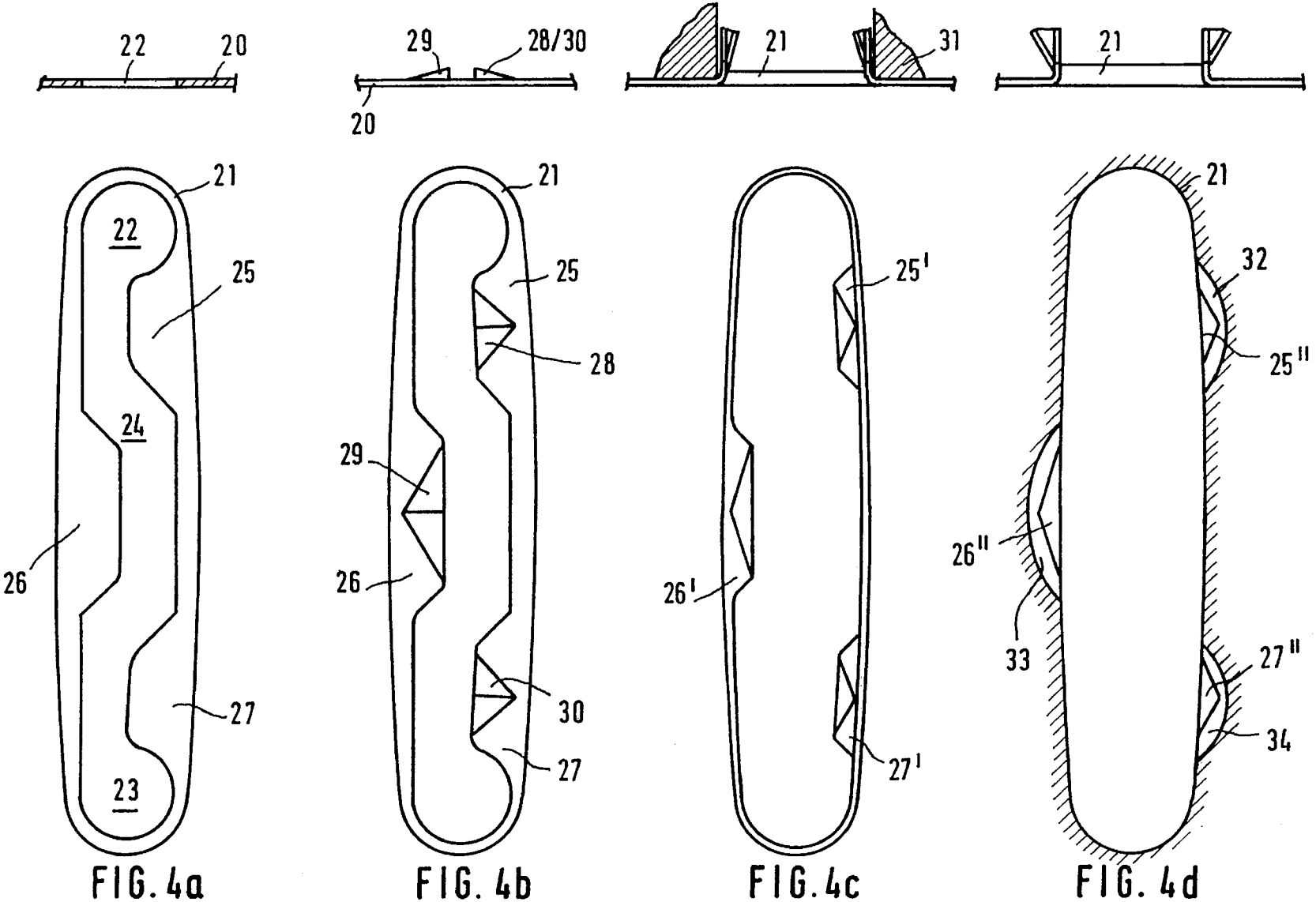

As already indicated by the line 11 in FIG. 3, FIGS. 4*a*, 4*b*, 4*d* and 4*d* now show the individual steps of the process for the production of the pass-through element according to the invention. FIG. 4*a* shows the fin sheet 20 after the punching, that is to say a strip 24 having rounded ends 22, 23 is cut out of the plane fin sheet 20 by means of a suitable perforating punch, while offset tabs 25, 26, 27 are cut free. As shown in FIG. 4*b*, in the following step of the process, by means of a stamping punch, noses 28, 29, 30 are impressed in these tabs 25, 26, 27, the noses having a pyramidal shape, that is to say being formed of two plane triangular surfaces inclined relative to one another. In the next step of the process, as illustrated in FIG. 4*c*, the pass-through element 21 is drawn in, that is to say only "tilted", against a die 31 having a correspondingly oval-shaped bending edge, so that the noses come to lie straight against the inner wall of the die 31 but the remainder of the pass-through element 21 still has a conical shape In FIG. 4*c* the tabs 25' 26' 27' are thus shown shortened in relation to FIG. 4*b*.

In the last step of the process, shown in FIG. 4*d*, the pass-through element is completed, that is to say the collar 21 is formed by means of a punch (not shown), so that it acquires a cylindrical shape (having a flat oval cross section) and the noses 25", 26", 27" project outwards as triangles, which is made possible by means of corresponding cutouts 32, 33, 34 in the die. By the process described the pass-through elements in which the noses are formed can be produced in a simple manner, quickly and with uniform quality.

Another process is also possible, in which the steps of the process according to FIGS. 4*b* and 4*c* are carried out only at the end, namely with the aid of a stamping punch which is introduced from above into the completed pass-through element.

Figure 5:
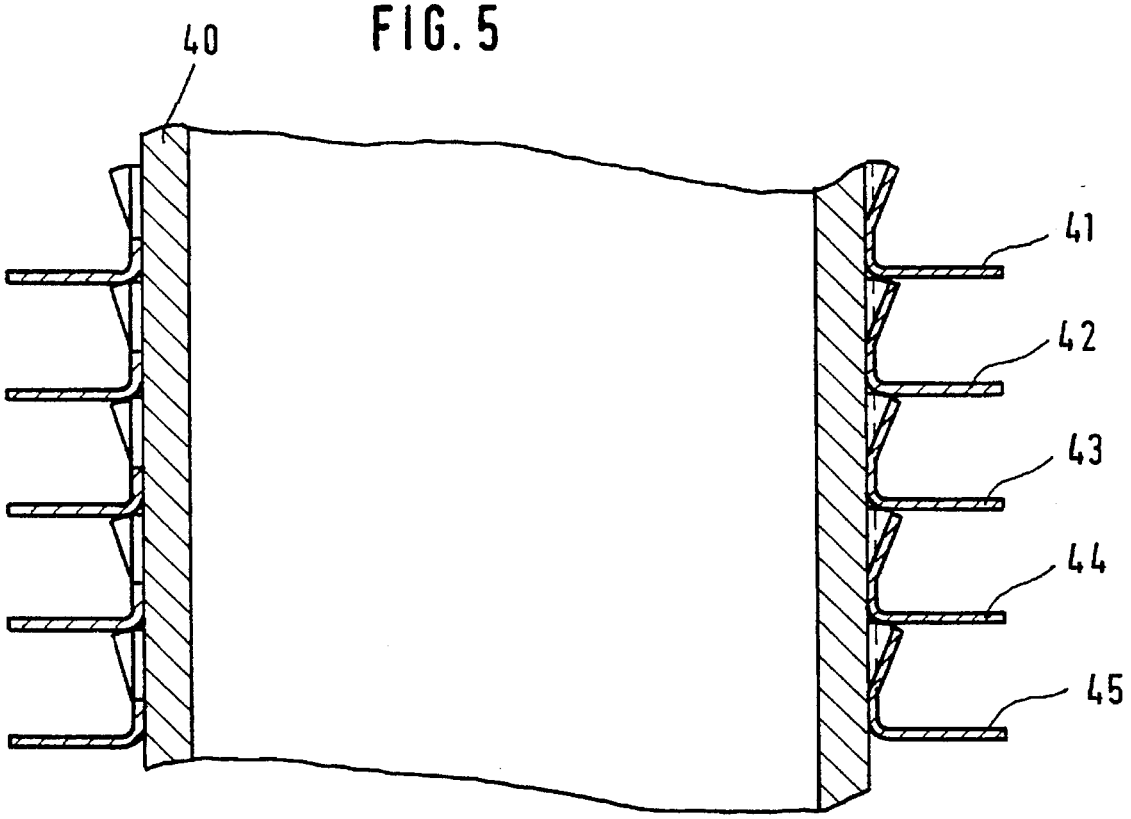
FIG. 5 shows on a larger scale a tube provided with fins.

FIG. 5 shows on a larger scale a section of a tube 40 onto which fins 41 to 45 have been "threaded". This tube 40 is part of a heat exchanger (not further shown), the shape and pitch of whose tubes and the formation of whose fins could correspond to FIG. 1. As already mentioned, the fins 41 to 45 are joined mechanically to the tube 40, that is to say are connected by a metallic interference fit through expansion of the tube 40 in relation to the pass-through elements of the fins. No soldering or adhesive bonding, that is to say joining of materials, is therefore required.

Figure 6:
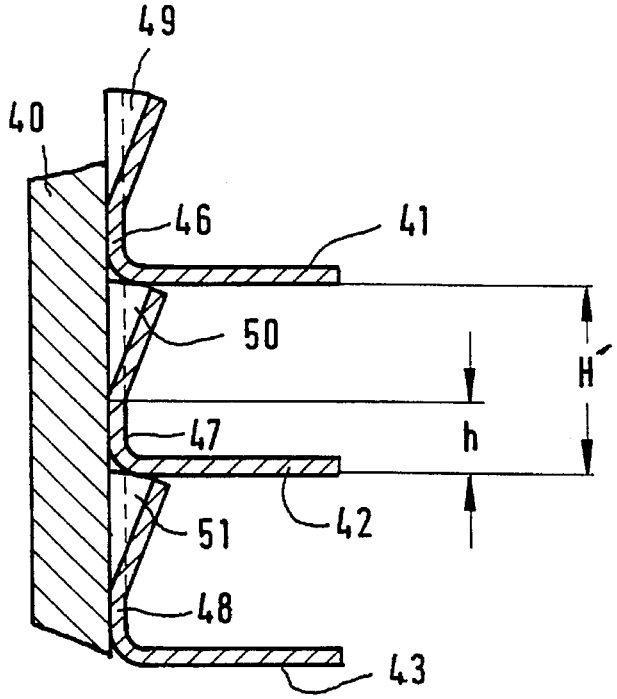
FIG. 6 shows a detail from FIG. 5: a tube wall together with fin pass-through elements.

FIG. 6 shows on a larger scale a part of FIG. 5, namely a part of the tube wall 40 and three fin portions 41, 42, 43, the pass-through elements 46, 47, 48 of which, having the height h, lie closely circumferentially against the tube 40, while their noses 49, 50, 51 project from the outside wall of the tube 40 and, by means of their top edge, fix the spacing H' of the fins 41, 42, 43. The fin spacing H' is slightly smaller than the height H of the tabs (see FIGS. 3*b* and 3*c*), because the pass-through element of the fin has a transition radius on which the noses are supported. Both FIGS. 5 and 6 show the completed tube and fin arrangement, that is to say in the completely mechanically connected state of the tube and pass-through elements of the fins after the expansion of the tube 40.

Fins of this kind, which are connected to a nest of parallel tubes which in turn are received in tube plates of collecting tanks, are used in particular in heat exchangers for motor vehicles, for example as radiators for the air cooling of engine coolants or as heat exchangers for heating systems. In such cases flat oval tube cross sections have an advantageous effect in respect of the pressure drop on the air side.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. A fin for a heat exchanger, the heat exchanger including of a matrix of tubes and of fins disposed transversely to the tubes, said fin comprising:

pass-through elements to receive the tubes which are to be joined mechanically, while a first medium flows through the tubes and the fin is acted on by a second medium; and a plurality of integral spacers for positioning an adjacent fin in a fin pitch;

wherein the integral spacers are in a form of convex surface protrusions stamped out of the pass-through elements and distributed over a periphery of the pass-through elements.

2. The fin as claimed in claim 1, wherein a cross section of the tubes and of the pass-through elements is circular.

3. The fin as claimed in claim 1, wherein a cross section of the tubes and of the pass-through elements is oval or elliptical, having an axis ratio greater than 3:1.

4. The fin as claimed in claim 1, wherein the convex surface protrusions widen in the pass-through direction and form a top contact edge.

5. The fin as claimed in claim 2, wherein the convex surface protrusions widen in the pass-through direction and form a top contact edge.

6. The fin as claimed in claim 3, wherein the convex surface protrusions widen in the pass-through direction and form a top contact edge.

7. The fin as claimed in claim 4, wherein the convex surface protrusions have, in a plane parallel to the fin, a cross section selected from the group consisting of semicircular, circular segment-shaped, semi-elliptical, and triangular.

8. The fin as claimed in claim 7, wherein a bottom edge of the noses convex surface protrusions is arranged approximately at a height h above the plane of the fin, and wherein a circumferential pass-through ring lying all around against the tube is thus defined.

9. The fin as claimed in claim 8, wherein the convex surface protrusions are each stamped out of tabs whose height H is greater than the height h of the remainder of the pass-through element.

10. The fin as claimed in claim 1, wherein the convex surface protrusions are arranged on longitudinal sides of the pass- through element.

11. The fin as claimed in claim 10, wherein the convex protrusions are offset relative to one another.

12. The fin as claimed in claim 1, wherein each of the convex surface protrusions have a maximum height portion at a center part of said each convex surface protrusion and wherein said each convex surface protrusion has outwardly falling edges from the center part to respective right and left end parts of said each convex surface protrusion so as to define a nose shape.

13. A heat exchanger comprising:

a matrix of mechanically joined tubes and of fins disposed transversely with respect to the tubes, said fins having pass-through elements to receive the mechanically joined tubes, while a first medium flows through the mechanically joined tubes and the fins are acted on by a second medium and are positioned in fin pitch by integral spacers, wherein the integral spacers are in a form of convex surface protrusions stamped out of the pass-through elements and distributed over a periphery of the pass-through elements, wherein the convex surface protrusions widen in a pass-through direction and form a top contact edge, wherein the convex surface protrusions have, in a plane parallel to the fin, a cross section selected from the group consisting of semicircular, circular segment-shaped, semi-elliptical, and triangular, wherein a bottom edge of the convex surface protrusions is arranged approximately at a height h above the plane of the fin, wherein a circumferential pass-through ring lying around each of the mechanically joined tubes is thus defined, and wherein the convex surface protrusions are each stamped out of tabs whose height H is greater than the height h of the remainder of the pass-through element.

14. A fin for a heat exchanger, the heat exchanger including a matrix of tubes and of fins disposed transversely to the tubes, said fin comprising:

a plurality of pass-through elements arranged in two separate rows on said fin, said pass-through elements of a first of said two rows being offset relative to said pass-through elements of a second of said two rows;

a plurality of integral spacers for positioning an adjacent fin against said fin in a fin pitch, wherein a first medium flows through the tubes and said fin and said adjacent fin are acted on by a second medium, and wherein the integral spacers are in a form of convex surface protrusions stamped out of the pass-through elements and distributed over a periphery of the pass-through elements.

15. The fin as claimed in claim 14, wherein a cross section of the tubes and of the pass-through elements is one of oval and elliptical, wherein the convex surface protrusions of said fin widen in the pass-through direction and form a top contact edge for said adjacent fin, wherein a bottom edge of the convex surface protrusions is arranged approximately at a height h above a plane of said fin, wherein a circumferential pass-through ring lying around each of the tubes is thus defined, and wherein the convex surface protrusions are each stamped out of tabs, with the convex surface protrusions having a height H which is greater than the height h which corresponds to a height of a remainder of the pass-through elements.

16. The fin as claimed in claim 15, further comprising:

a plurality of gill areas arranged in the two separate rows on said fin, said gill areas of the first of said two rows being offset relative to said gill areas of the second of said two rows, wherein said gill areas of the first and second rows are respectively disposed between adjacent ones of said pass-through elements of the first and second rows.

17. The fin as claimed in claim 16, wherein the convex surface protrusions of each of said pass-through elements include a first convex surface protrusion arranged approximately at a substantially longitudinal center position of one longitudinal side of said each pass-through element, and a second and a third convex surface protrusion arranged at a position which is not at the substantially longitudinal center position of another longitudinal side of said each pass-through element.

18. The fin as claimed in claim 14, wherein each of the convex surface protrusions has a maximum height portion at a center part of said each convex surface protrusion and wherein said each convex surface protrusion has outwardly falling edges from the center part to respective right and left end parts of said each convex surface protrusion so as to define a nose shape.

* * * * *